US007510442B2

(12) United States Patent
Takahashi et al.

(10) Patent No.: US 7,510,442 B2
(45) Date of Patent: Mar. 31, 2009

(54) CONNECTOR

(75) Inventors: Hirokazu Takahashi, Tokyo (JP); Yasuyuki Mizunuma, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/705,175

(22) Filed: Feb. 9, 2007

(65) Prior Publication Data

US 2007/0155246 A1 Jul. 5, 2007

(30) Foreign Application Priority Data

Mar. 1, 2006 (JP) ..... 2006-054843

(51) Int. Cl.
*H01R 24/00* (2006.01)

(52) U.S. Cl. ..... 439/630; 235/492

(58) Field of Classification Search ..... 439/630; 235/492

See application file for complete search history.

(56) References Cited

U.S. PATENT DOCUMENTS 6,796,842 B1 * 9/2004 Wang ..... 439/630
7,044,796 B2 * 5/2006 Tsai ..... 439/630
7,147,515 B1 * 12/2006 Hung et al. ..... 439/630
7,153,165 B2 * 12/2006 Lai et al. ..... 439/630
7,153,166 B2 * 12/2006 Katoh et al. ..... 439/630
2004/0082225 A1 * 4/2004 Hung et al. ..... 439/630
2004/0214474 A1 * 10/2004 Tsai ..... 439/630
2005/0037667 A1 * 2/2005 Yu ..... 439/630

FOREIGN PATENT DOCUMENTS

JP 2003-297460 10/2003

* cited by examiner

*Primary Examiner*—Gary F. Paumen
(74) *Attorney, Agent, or Firm*—Abelman, Frayne & Schwab

(57) ABSTRACT

A connector includes a housing and a plurality of contacts, and the bottom portion of the housing has a holding bar for holding the contacts. In a region of the bottom portion of the housing corresponding to tips of all the contacts extending from the holding bar upwardly and toward the interior of the housing, a rectangular recess is provided, and a contact buckling-preventing plate is provided in the recess, which includes an upper surface portion formed with through-holes at locations corresponding to contact portions of the contacts, partition walls forming defined spaces for accommodating the contacts in cooperation with the upper surface portion, and jointing ends to be connected to both lateral inner ends of the recess on the side of the holding bar to permit a pivotal movement of the plate. In this manner, the connector can realize an even more reduced overall height and prevent the buckling of contacts upon extraordinary insertion and removal of a card-shaped connecting object.

19 Claims, 7 Drawing Sheets

CONNECTOR

BACKGROUND OF THE INVENTION

This invention relates to a connector comprising a housing made of an insulating material having a bottom portion and side walls, and a plurality of contacts made of an elastic material held in the bottom portion of the housing and each having a contact portion at a location where it contacts a contact element provided on a card-shaped connecting object such as, for example, an IC card and memory card inserted in a predetermined position in the housing, and more particularly to a connector being capable of effectively preventing the buckling of contacts when a card-shaped connecting object is extraordinarily inserted into and removed from the housing, while realizing a more reduced overall height of the connector.

A connector used for connecting a card-shaped connecting object such as an IC card and memory card has been known as shown in, for example, FIGS. 1 and 2. The connector 100 shown in FIGS. 1 and 2 includes a housing 105 made of an insulating material having a bottom portion 101, side walls 102 and 103, and a rear wall 104, a plurality of contacts 106 held in the bottom portion 101 of said housing 105 and each having a contact portion 107 at a location where it contacts a contact element provided on a card-shaped connecting object inserted in a predetermined position in the housing 105, and a holding bar 108 provided in the bottom portion 101 of the housing 105 for holding the contacts 106 in a laterally aligned relationship at predetermined intervals.

In such a connector 100, the contacts 106 are made of an elastic material and extend from the holding bar 108 upwardly and toward the interior of said housing 105 so that tips 109 of the contacts 106 are arranged in an exposed state as free ends. Therefore, when the card-shaped connecting object has been inserted, the tips 109 of the contacts 106 are pushed downwardly, while after the card-shaped connecting object has been removed, the tips 109 of the contacts 106 move upwardly to their initial positions with the aid of the restoring force of their springy elasticity.

With such a connector 100, however, under extraordinarily used conditions in that a card-shaped connecting object is forced into or out of slots 110 provided in both the side walls of the housing irrespective of resistance, the contacts 106 would be pushed downwardly to an excessive extent so that the contacts 106 are frequently deformed in their plastic zone beyond their elastic zone. In such an event, the contacts 106 are buckled and could not be restored to their original positions so that there is a risk of causing defective or failed electrical connection.

As an approach for preventing the buckling of contacts, Japanese Patent Application Opened No. 2003-297,460 (Patent Literature 1) has proposed to provide particular contacts each having a spring portion which extends from a holding portion and is bent in the form of a clip (having a U-shaped cross-section) to provide a sufficient elasticity to the spring portion.

With this approach of the prior art disclosed in the above Patent Literature 1, the contacts must necessarily be of a large profile due to their shape described above, thereby causing a problem of higher overall dimension of the connector.

SUMMARY OF THE INVENTION

It is an object of the invention to provide a connector provided with a contact buckling-preventing plate of a predetermined shape to prevent the buckling of contacts effectively when a card-shaped connecting object is extraordinarily inserted into and removed from the housing, while realizing a more reduced overall height of the connector.

In order to achieve the above object, the connector according to the invention comprises a housing made of an insulating material having a bottom portion and side walls, and a plurality of contacts made of an elastic material held in the bottom portion of said housing, and the bottom portion of said housing having a holding bar for holding the contacts in a laterally aligned relationship at predetermined intervals, and said contacts each having a contact portion at a location where it contacts a contact element provided on a card-shaped connecting object inserted in a predetermined position in the housing, wherein a rectangular recess is provided in a region of the bottom portion of the housing corresponding to tips of all said contacts extending from said holding bar upwardly and toward the interior of said housing, and a contact buckling-preventing plate is provided in said recess, which comprises an upper surface portion formed with through-holes at locations corresponding to said contact portions of the respective contacts, partition walls forming defined spaces therebetween for accommodating said contacts in cooperation with the upper surface portion, and jointing ends to be connected to both lateral inner ends of said recess positioned on the side of said holding bar in a manner to allow pivotal movement of the contact buckling-preventing plate.

Preferably the jointing ends of said plate each include a first projection pin extending from respective lateral end of the plate and rotationally fitted in a first notch hole provided in each of both the lateral inner ends of the recess.

It is preferable to form said recess as a through-hole passing through the bottom portion.

The contact portions of the contacts are preferably positioned just as high as or slightly higher than the surface position of the upper surface portion of said plate when the card-shaped connecting object has been inserted in the predetermined position in the housing.

It is preferable that said plate is provided with second projection pins each extending from a lateral end on the side of the free end of the plate, and both the lateral inner ends of the recess are each provided with a second notch hole for limiting upward movement of said second projection pin.

Said recess is preferably provided with stoppers at lower positions corresponding to said partition walls positioned at least on the side of both the lateral ends of said plate for limiting downward movement of the free end of said plate.

A long edge of the upper surface portion of said plate positioned near to and/or remote from the holding bar is rounded in cross-section over at least two portions on both sides.

According to the invention, by providing the contact buckling-preventing plate of the predetermined shape, it becomes possible to provide a connector enabling effective prevention of the buckling of contacts when a card-shaped connecting object is extraordinarily inserted into and removed from the housing, while realizing a more reduced overall height of the connector.

DESCRIPTION OF THE PREFERRED EMBODIMENTS

Best mode for carrying out the invention will then be explained with reference to the drawings hereinafter.

Figure 1:
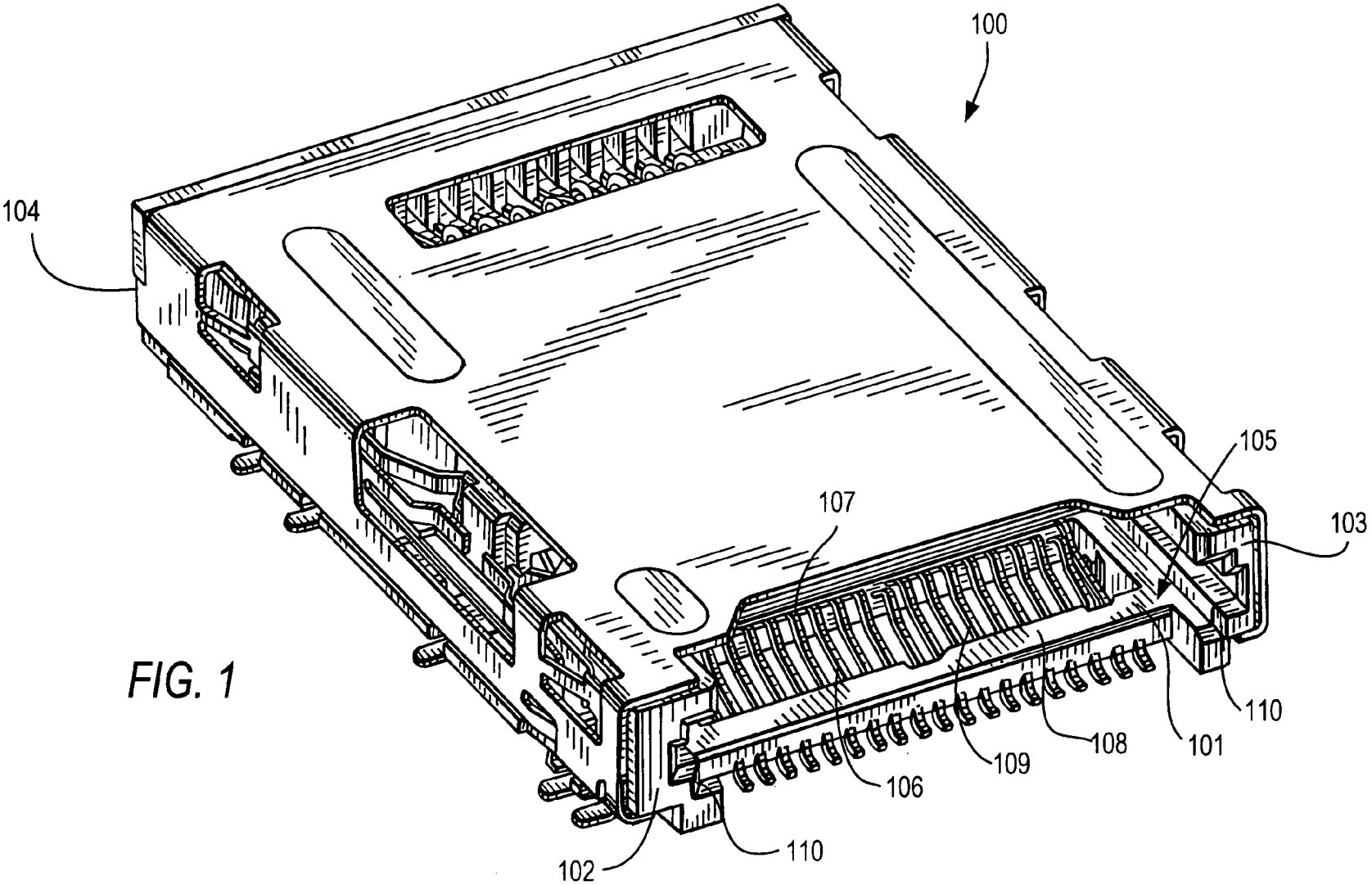
FIG. 1 is a perspective view of the connector of the prior art viewed from the above on the front side.
Figure 2:
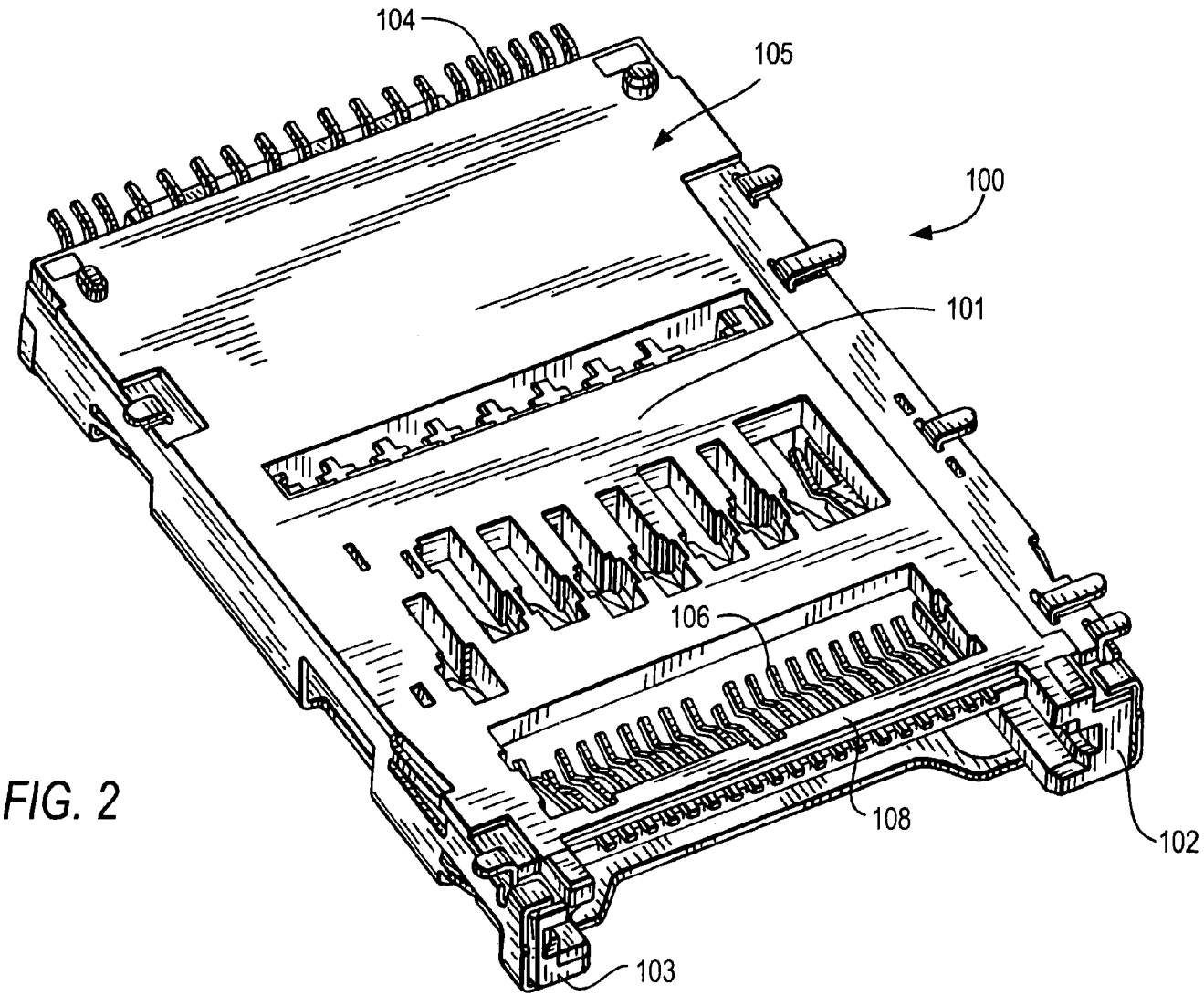
FIG. 2 is a perspective view of the connector shown in FIG. 1 viewed from the below on the front side.
Figure 3:
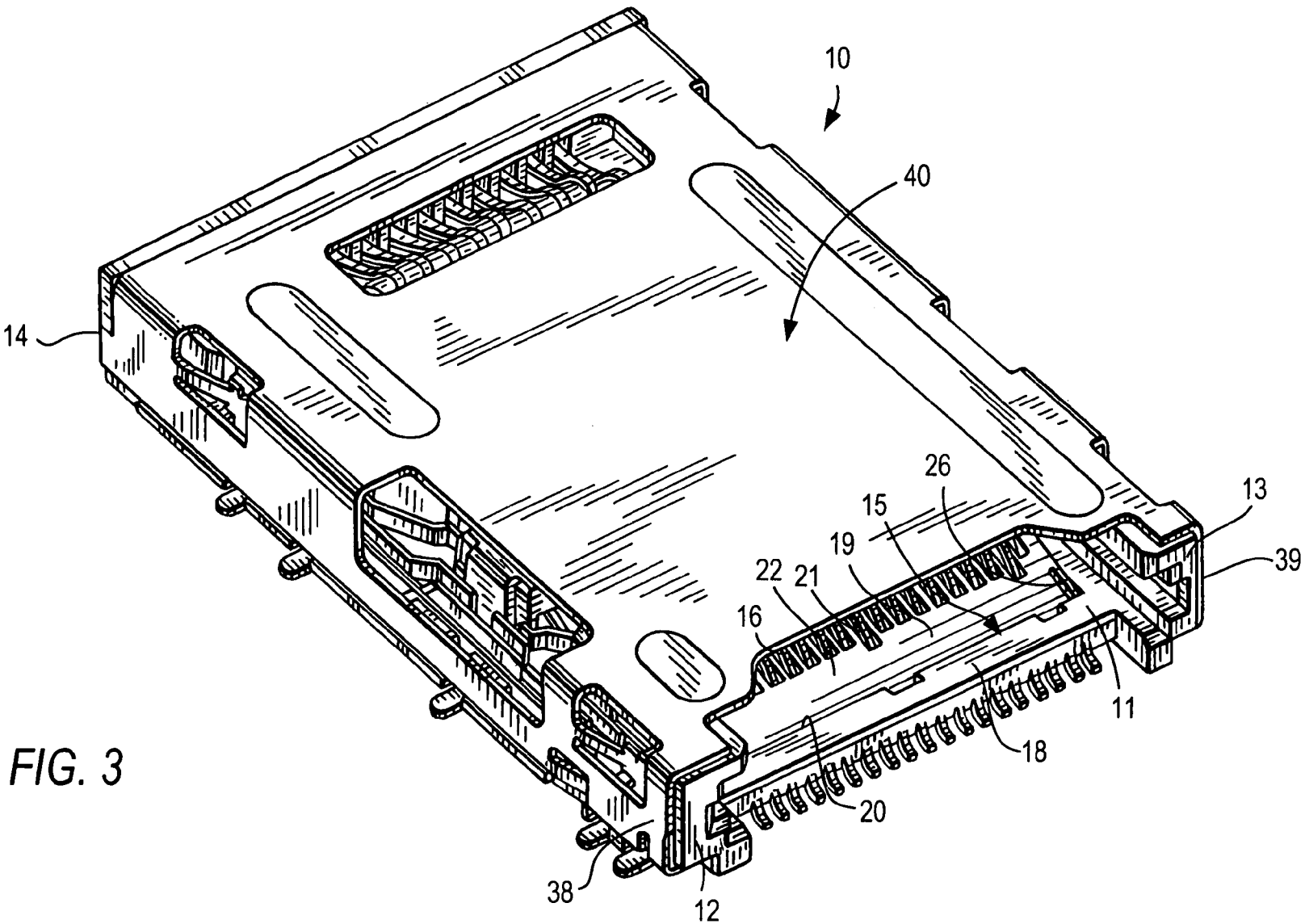
FIG. 3 is a perspective view of a typical connector according to the invention viewed from the above on the front side.
Figure 4:
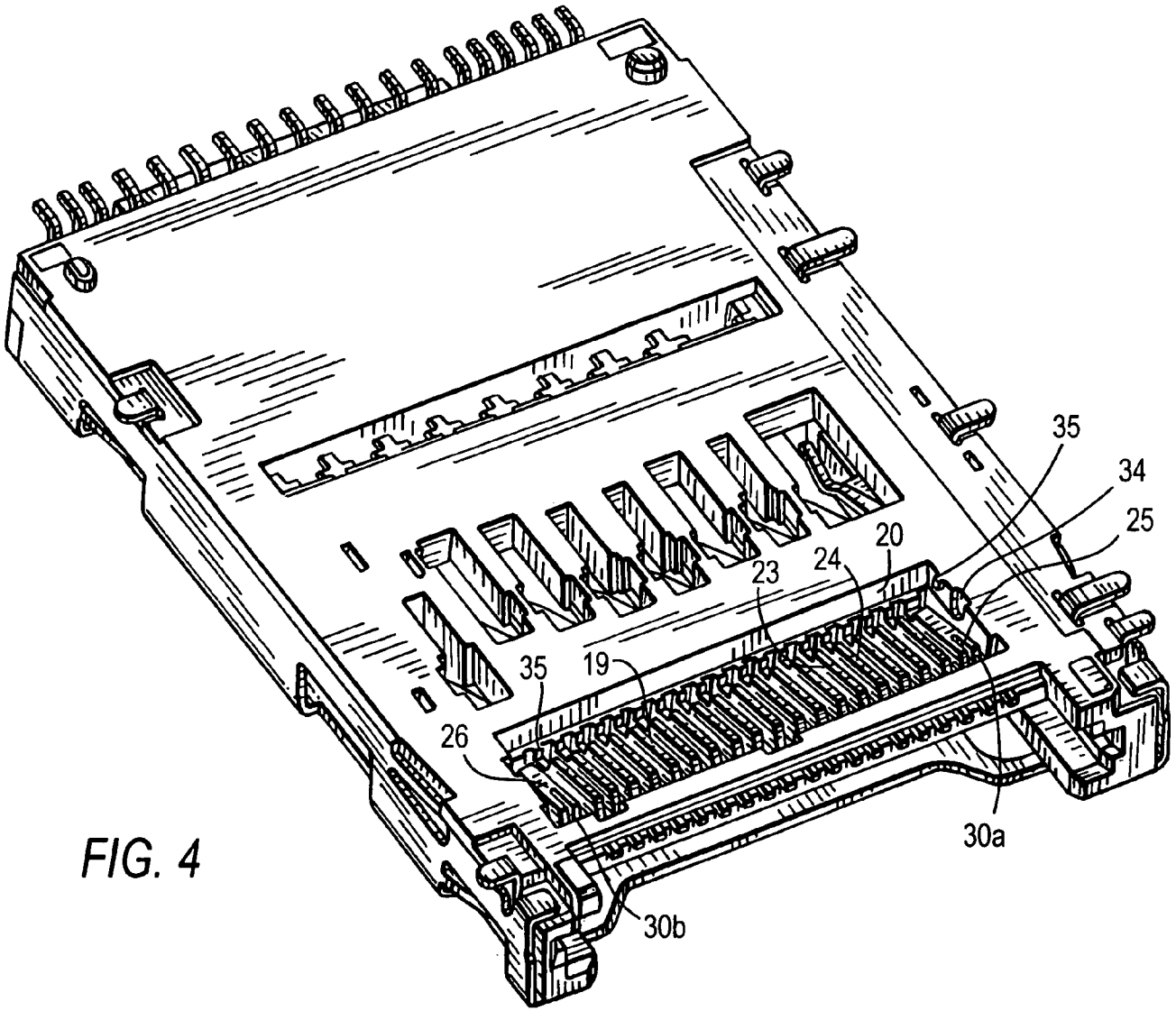
FIG. 4 is a perspective view of the connector shown in FIG. 3 viewed from the below on the front side.
Figure 5:
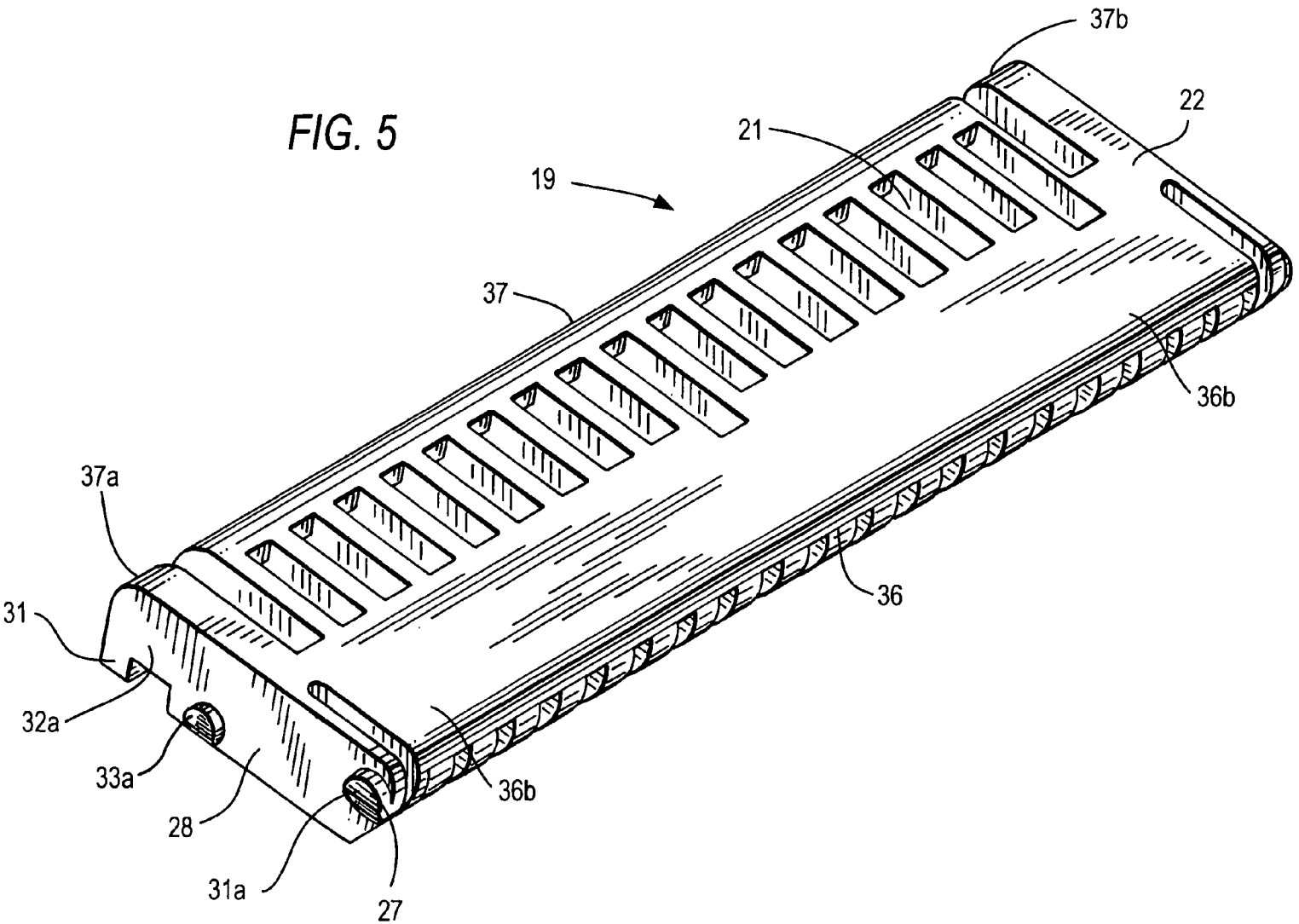
FIG. 5 is a perspective view of a contact buckling-preventing plate which is one component of the connector shown in FIG. 3 viewed from the above on the connection end.
Figure 6:
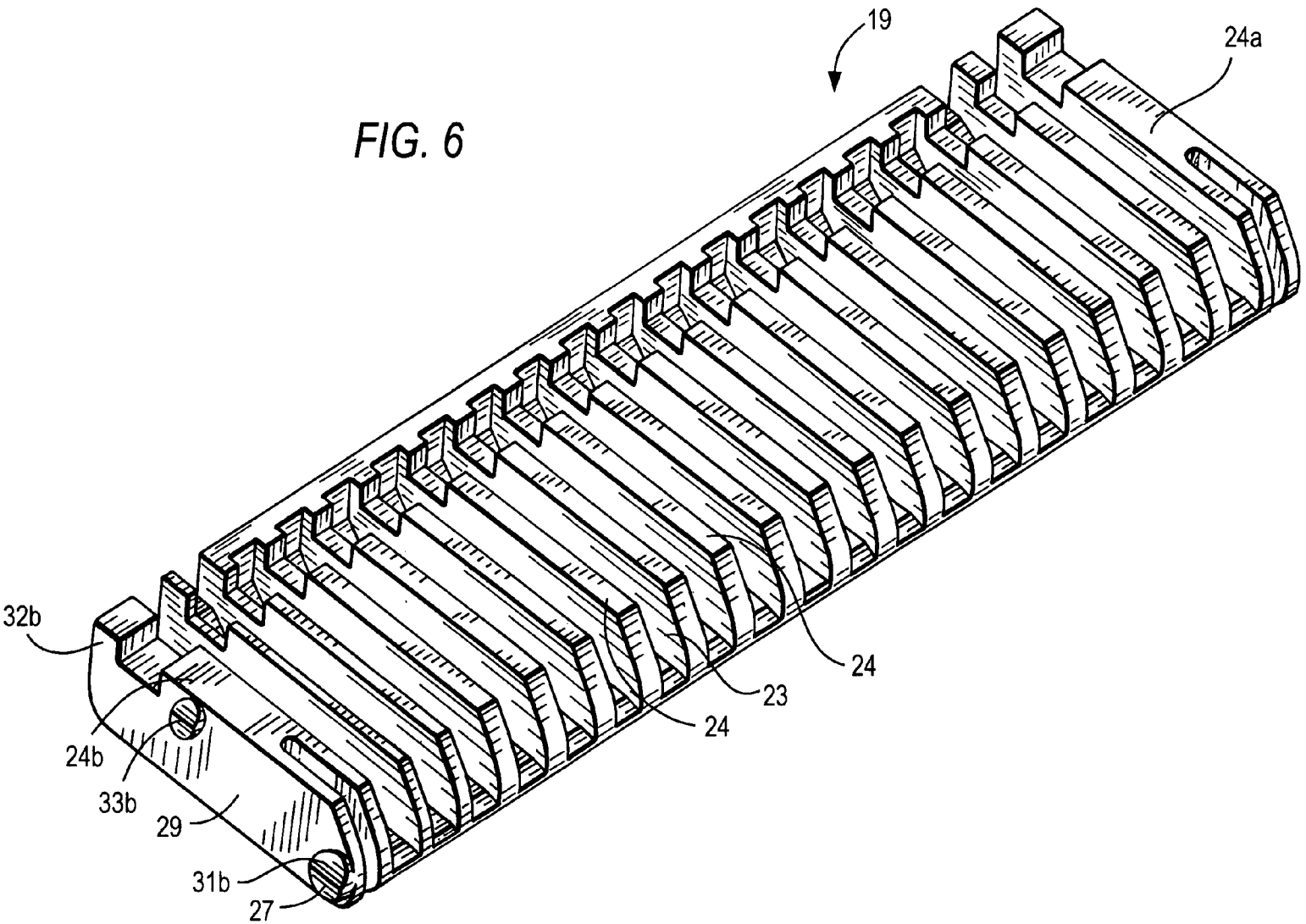
FIG. 6 is a perspective view of the contact buckling-preventing plate which is one component of the connector shown in FIG. 3 viewed from the below on the connection end.

FIGS. 3 and 4 illustrate a typical connector according to the invention, and FIG. 3 is a perspective view of the connector viewed from the above on the front side and FIG. 4 is a perspective view of the connector viewed from the below on the same side. FIGS. 5 and 6 illustrate a contact buckling-preventing plate which is one component of the connector shown in FIG. 3, and FIG. 5 is a perspective view of said plate viewed from the above on the connection end and FIG. 6 is a perspective view of said plate viewed from the below on the connection end. Further, FIGS. 7*a* to 7*e* are views for explaining the operation of the contact buckling-preventing plate until a card-shaped connecting object has been inserted into the normal inserted position in the housing.

The connector 10 illustrated in the drawings comprises a housing 15 made of an insulating material having a bottom portion 11, both side walls 12 and 13 and a rear wall 14, and a plurality of contacts 16 held in the bottom portion 11 of the housing 15. The contacts 16 each include a contact portion 17 at a location where it can contact a contact element provided on the under surface of the card-shaped connecting object C which has been inserted in a predetermined position in the housing 15 (FIG. 7*e*). The bottom portion 11 of the housing 15 includes a holding bar 18 for holding the contacts 16 in a laterally aligned relationship at predetermined intervals. In the drawing illustrating the embodiment, the housing 15 is integrally formed with the holding bar 18, but it may be provided separately from the housing 15.

Forming an important constituting feature of the invention is the contact buckling-preventing plate 19 which has a predetermined shape and is arranged at an appropriate position. In more practically, a rectangular recess 20 is provided in a region of the bottom portion 11 of the housing corresponding to tips of all the contacts 16 extending from said holding bar 18 upwardly and toward the interior of the housing 15. Arranged in said rectangular recess 20 is the contact buckling-preventing plate 19 comprising an upper surface portion 22 formed with through-holes or slots 21 at locations corresponding to the contact portions 17 of the respective contacts 16, partition walls 24 forming defined spaces 23 therebetween for accommodating said respective contacts 16 in cooperation with the upper surface portion 22, and jointing ends or pivot joints 27 adapted to be connected to both lateral inner ends 25 and 26 of said recess 20 on the side of the holding bar 18 in a manner to allow pivotal movement of the contact buckling-preventing plate 19. Employing this construction can allow an even more reduced overall height of the connector and effective prevention of buckling of the contacts in the event that a card-shaped connecting object is extraordinarily inserted into and removed from the housing.

Moreover, both the jointing ends or pivot joints 27 of the plate 19 each include a first projection pin 31*a*, 31*b* extending from respective lateral end 28, 29 of the plate 19 and rotationally fitted in a first notch hole 30*a*, 30*b* provide in each of both the lateral inner ends 25 and 26 of the recess 20. The shapes of the first notch holes 30*a* and 30*b* and the first projection pins 31*a* and 31*b* may not be limited so long as the plate 19 is pivotally movable about the first notch holes 30*a* and 30*b* with the aid of the jointing ends 27 as pivot pins.

As shown in FIGS. 3 and 4, it is preferable to form the recess 20 as a through-hole which passes through the bottom portion 11 of the housing 15 from the standpoint of the miniaturization (reduced overall height) of the connector.

In order to obtain a favorable contact pressure between the contact portions 17 of the contacts 16 and the contact elements of the card-shaped connecting object, it is preferable that the contact portions 17 of the contacts 16 are positioned just as high as or slightly higher than the surface position of the upper surface portion 22 of said plate 19 when the card-shaped connecting object C has been inserted in the predetermined position of the housing 15 (FIG. 7*e*).

Preferably, said plate 19 is provided with second projection pins 33*a* and 33*b* each extending from a lateral end 32*a*, 32*b* on the side of the free end 31 of the plate 19, while both the lateral inner ends 25 and 26 of the recess 20 are each provided with a second notch hole 34, 34 for limiting upward movement of the second projection pin 33*a*, 33*b*, thereby preventing the plate from being dislodged.

Preferably, said recess 20 is provided with stoppers 35 at lower positions corresponding to the partition walls positioned at least on the sides of both lateral ends 32*a* and 32*b* of said plate 19 or corresponding to the partition walls 24*a* and 24*b* positioned on the sides of both the lateral ends 32*a* and 32*b* of the plate 19 in FIG. 4, thereby limiting the downward movement of the free end 31 of the plate 19. In this way, the tips of the contacts are prevented from being pressed downwardly to an excessive extent resulting in buckling of the contacts.

In addition, it is preferable for the operation of the plate that the long edge 36 of the upper surface portion 22 of said plate 19 positioned near to the holding bar 11 is given curvature in cross-section over at least two portions 36*a* and 36*b* on both sides, or over the full length of the long edge 36 in the example shown in FIG. 5. A radius of curvature of such a rounded portion in cross-section is preferably within a range of 0.1 mm to 0.5 mm.

Moreover, it is preferable for preventing a card from being caught or entrapped when the card is being removed that the long edge 37 of the upper surface portion 22 of said plate 19 positioned remote from the holding bar 11 is given curvature for rounding in cross-section over at least two portions 37*a* and 37*b* on both sides, or over the full length of the long edge 37 in the example shown in FIG. 5. A radius of curvature of such a rounded portion in cross-section is preferably within a range of 0.5 mm to 1 mm.

In the embodiment shown in FIGS. 3 and 4, there is provided a cover 40 having side wall portions 38 and 39 engaging the side walls 12 and 13 of the housing 15, respectively, and arranged to cover the whole upper surface of the housing 15 for the purpose of increasing the strength of the connector and further reducing its overall height.

The operation of the contact buckling-preventing plate 19 until a card-shaped connecting object C has been inserted into a normal inserted position will then be explained using FIG. 7.

Before the card-shaped connecting object C is inserted into the housing 15 of said connector 10, the free end of the plate 19 is positioned above the surface of the bottom portion of the housing (FIG. 7*a*) as a result of the pivotal movement of the plate 19 about the jointing ends connected to the recess 20 on the side of the holding bar 18 owing to the elastic force of the tips of the contacts received in the defined spaces. At this time, the free end of the plate can be set at an appropriate position by means of the second projection pins provided on the plate and the second notch holes provided in the lateral inner ends of the recess.

Figure 7A:
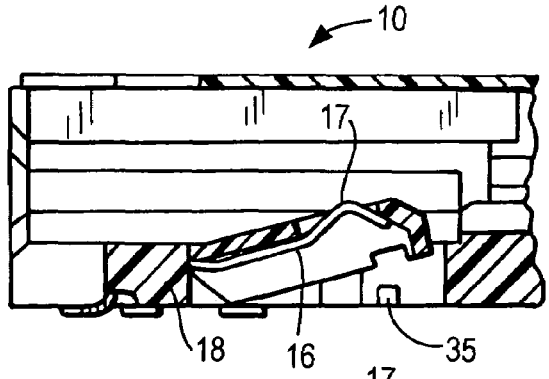
FIGS. 7*a* to 7*e* are views for explaining the operation of the contact buckling-preventing plate until a card-shaped connecting object has been inserted into the normal insertion position in the housing.
Figure 7B:
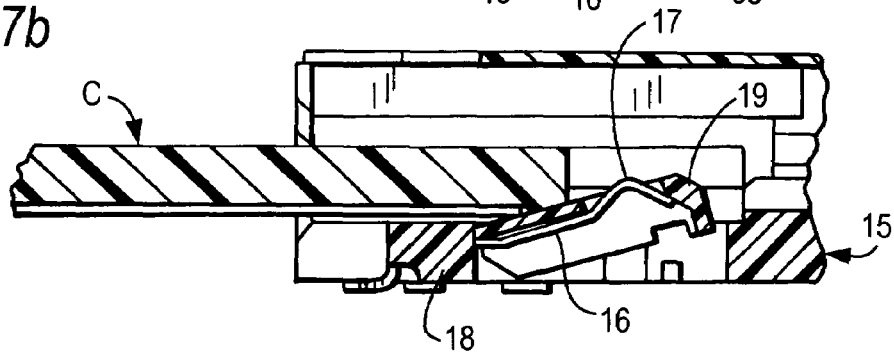

Subsequently, during the initial stage of the insertion of the card-shaped connecting object C into the housing 15 of the connector 10, the card-shaped connecting object C contacts the upper surface of the plate only without directly contacting the contacts as shown in FIG. 7*b*. As a result, a uniform pushing force acts on each of the contacts.

Figure 7C:
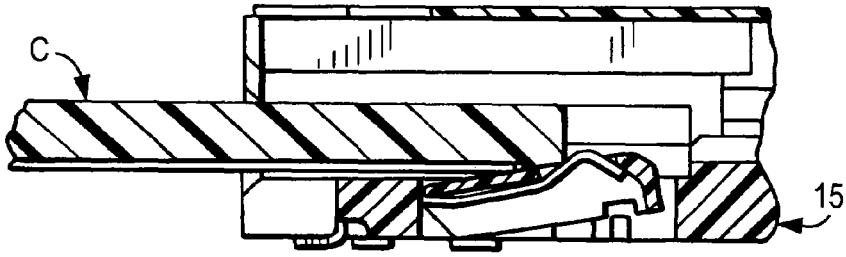

Thereafter, the card-shaped connecting object C is being inserted into the housing so that the upper surface of the plate is pushed to move downwardly, with the result that the contact portions of the contacts relatively appear or extend upwardly from the plate 16 through the through-holes 21 formed in the upper surface portion 22 of the plate 19 (FIG. 7*c*). In this situation, the most of the pushing force of the card-shaped connecting object acts on the plate so that the pushing force does not concentrate onto individual contacts.

Figure 7D:
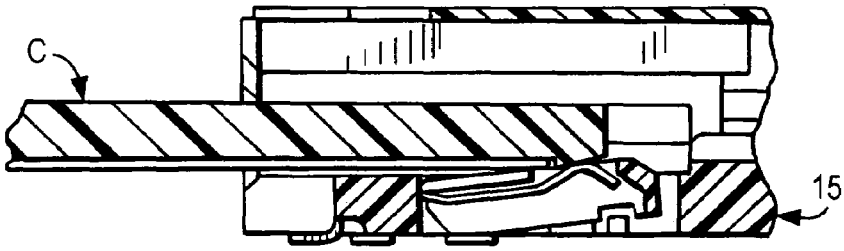
Figure 7E:
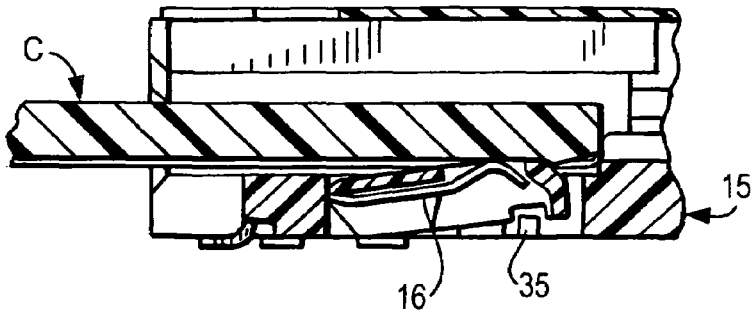

Then, the card-shaped connecting object C is further being inserted into the housing as shown in FIG. 7*d* so that the card-shaped connecting object C becomes directly pushing the contact portions of the contacts and thereafter the lower surface of the card-shaped connecting object C slidably moves on the contact portions of the contacts as shown in FIG. 7*d*.

Upon insertion of the card-shaped connecting object C in the normal inserted position, the contact portions of the contacts can contact the contact elements provided on the under surface of the card-shaped connecting object C at suitable pressures. At this time, in order to more effectively prevent the buckling of the contacts caused by excessive pushing forces, it is preferable to provide the While the invention has been shown and described with reference to the preferred embodiments thereof, it will be understood by those skilled in the art that various modifications can be made therein without departing from the scope of the claims.

According to the invention, by providing the contact buckling-preventing plate of the predetermined shape, it becomes possible to provide a connector realizing an even more reduced overall height and enabling effective prevention of the buckling of contacts when a card-shaped connecting object is extraordinarily inserted into and removed from the housing.

What is claimed is:

1. A connector for receiving and electronically connecting to a card shaped connecting object, comprising a housing made of an insulating material having a bottom portion and side walls, and a plurality of electrical contacts made of an elastic material held in the bottom portion of said housing, and the bottom portion of said housing having a holding bar for holding the contacts in a laterally aligned relationship at predetermined intervals, and said contacts each having a contact portion at a location where it contacts a contact element provided on said card-shaped connecting object inserted in a predetermined position in the housing, wherein a rectangular recess is provided in a region of the bottom portion of the housing corresponding to tips of all said contacts extending from said holding bar upwardly and toward the interior of said housing, and a contact buckling-preventing plate is provided in said recess, which comprises an upper surface portion formed with through-holes at locations corresponding to said contact portions of the respective contacts, partition walls forming defined spaces therebetween for housing said contacts in cooperation with the upper surface portion, and pivot joints to be connected to both lateral inner ends of said recess positioned on the side of said holding bar in a manner to allow pivotal movement of the contact buckling-preventing plate.

2. The connector as set forth in claim 1, wherein the pivot joints of said plate each include a first projection pin extending from each respective lateral end of said plate and rotationally fitted in a first notch hole provided in each of both the lateral inner ends of the recess.

3. The connector as set forth in claim 1, wherein said recess is formed as a through-hole passing through said bottom portion.

4. The connector as set forth in claim 1, wherein said contact portions of the contacts are positioned just as high as or slightly higher than the surface position of the upper surface portion of said plate when the card-shaped connecting object has been inserted in said predetermined position in the housing.

5. The connector as set forth in claim 1, wherein said recess is provided with stoppers at lower positions corresponding to said partition walls positioned at least on the side of both the lateral ends of said plate for limiting downward movement of the free end of said plate.

6. The connector as set forth in claim 1, wherein a long edge of the upper surface portion of said plate positioned near to the holding bar is given a curvature in cross-section over at least two portions on both sides.

7. The connector as set forth in claim 2, wherein said contact portions of the contacts are positioned just as high as or slightly higher than the surface position of the upper surface portion of said plate when the card-shaped connecting object has been inserted in said predetermined position in the housing.

8. The connector as set forth in claim 3, wherein said contact portions of the contacts are positioned just as high as or slightly higher than the surface position of the upper surface portion of said plate when the card-shaped connecting object has been inserted in said predetermined position in the housing.

9. The connector as set forth in claim 2, wherein said recess is provided with stoppers at lower positions corresponding to said partition walls positioned at least on the side of both the lateral ends of said plate for limiting downward movement of the free end of said plate.

10. The connector as set forth in claim 3, wherein said recess is provided with stoppers at lower positions corresponding to said partition walls positioned at least on the side of both the lateral ends of said plate for limiting downward movement of the free end of said plate.

11. The connector as set forth in claim 2, wherein a long edge of the upper surface portion of said plate positioned near to the holding bar is rounded in cross-section over at least two portions on both sides.

12. the connector as set forth in claim 5, wherein a long edge of the upper surface portion of said plate positioned near to the holding bar is rounded in cross-section over at least two portions on both sides.

13. The connector as set forth in claim 4, wherein a long edge of the upper surface portion of said plate positioned remote from the holding bar is rounded in cross-section over at least two portion on both sides.

14. A connector for receiving and electronically connecting to a card shaped connecting object comprising a housing made of an insulating material having a bottom portion and side walls, and a plurality of electrical contacts made of an elastic material held in the bottom portion of said housing, and the bottom portion of said housing having a holding bar for holding the contacts in a laterally aligned relationship at predetermined intervals, and said contacts each having a contact portion at a location where it contacts a contact element provided on a card-shaped connecting object inserted in a predetermined position in the housing, wherein a rectangular recess is provided in a region of the bottom portion of the housing corresponding to tips of all said contacts extending from said holding bar upwardly and toward the interior of said housing, and a contact buckling-preventing plate is provided in said recess, which comprises an upper surface portion formed with through-holes at locations corresponding to said contact portions of the respective contacts, partition walls forming defined spaces therebetween for housing said contacts in cooperation with the upper surface portion, and pivot joints to be connected to both lateral inner ends of said recess positioned on the side of said holding bar in a manner to allow pivotal movement of the contact buckling-preventing plate, wherein said pivot joints of said plate each include a first projection pin extending from each respective lateral end of said plate and rotationally fitted in a first notch hole provided in each of both the lateral inner ends of the recess, and wherein said plate is provided with second projection pins each extending from a lateral end on the side of the free end of said plate, and both said lateral inner ends of the recess are each provided with a second notch hole for limiting upward movement of said second projection pin.

15. A connector for receiving and electronically connecting to a card shaped connecting object comprising a housing made of an insulating material having a bottom portion and side walls, and a plurality of electrical contacts made of an elastic material held in the bottom portion of said housing, and the bottom portion of said housing having a holding bar for holding the contacts in a laterally aligned relationship at predetermined intervals, and said contacts each having a contact portion at a location where it contacts a contact element provided on a card-shaped connecting object inserted in a predetermined position in the housing, wherein a rectangular recess is provided in a region of the bottom portion of the housing corresponding to tips of all said contacts extending from said holding bar upwardly and toward the interior of said housing, and a contact buckling-preventing plate is provided in said recess, which comprises an upper surface portion formed with through-holes at locations corresponding to said contact portions of the respective contacts, partition walls forming defined spaces therebetween for housing said contacts in cooperation with the upper surface portion, and pivot joints to be connected to both lateral inner ends of said recess positioned on the side of said holding bar in a manner to allow pivotal movement of the contact buckling-preventing plate, wherein said pivot joints of said plate each include a first projection pin extending from each respective lateral end of said plate and rotationally fitted in a first notch hole provided in each of both the lateral inner ends of the recess, and wherein said plate is provided with second projection pins each extending from a lateral end on the side of the free end of the plate, and both said lateral inner ends of the recess are each provided with a second notch hole for limiting upward movement of said second projection pin.

16. A connector for receiving and electronically connecting to connecting a card shaped connecting object comprising a housing made of an insulating material having a bottom portion and side walls, and a plurality of electrical contacts made of an elastic material held in the bottom portion of said housing, and the bottom portion of said housing having a holding bar for holding the contacts in a laterally aligned relationship at predetermined intervals, and said contacts each having a contact portion at a location where it contacts a contact element provided on a card-shaped connecting object inserted in a predetermined position in the housing, wherein a rectangular recess is provided in a region of the bottom portion of the housing corresponding to tips of all said contacts extending from said holding bar upwardly and toward the interior of said housing, and a contact buckling-preventing plate is provided in said recess, which comprises an upper surface portion formed with through-holes at locations corresponding to said contact portions of the respective contacts, partition walls forming defined spaces therebetween for housing said contacts in cooperation with the upper surface portion, and pivot joints to be connected to both lateral inner ends of said recess positioned on the side of said holding bar in a manner to allow pivotal movement of the contact buckling-preventing plate, wherein said recess is formed as a through-hole passing through the bottom portion.

17. A connector for receiving and electronically connecting to connecting a card shaped connecting object comprising a housing made of an insulating material having a bottom portion and side walls, and a plurality of electrical contacts made of an elastic material held in the bottom portion of said housing, and the bottom portion of said housing having a holding bar for holding the contacts in a laterally aligned relationship at predetermined intervals, and said contacts each having a contact portion at a location where it contacts a contact element provided on a card-shaped connecting object inserted in a predetermined position in the housing, wherein a rectangular recess is provided in a region of the bottom portion of the housing corresponding to tips of all said contacts extending from said holding bar upwardly and toward the interior of said housing, and a contact buckling-preventing plate is provided in said recess, which comprises an upper surface portion formed with through-holes at locations corresponding to said contact portions of the respective contacts, partition walls forming defined spaces therebetween for housing said contacts in cooperation with the upper surface portion, and pivot joints to be connected to both lateral inner ends of said recess positioned on the side of said holding bar in a manner to allow pivotal movement of the contact buckling-preventing plate, wherein said contact portions of the contacts are positioned just as high as or slightly higher than the surface position of the upper surface portion of said plate when the card-shaped connecting object has been inserted in the predetermined position in the housing.

18. A connector for receiving and electronically connecting to a card shaped connecting object, comprising:

(a) a housing made of an insulating material having a bottom portion and side walls, (b) a plurality of electrical contacts made of an elastic material held in the bottom portion of said housing, (c) a holding bar in the bottom portion of said housing for holding said contacts in a laterally aligned relationship at predetermined intervals, said contacts each having a contact portion at a location where it contacts a contact element provided on a card-shaped connecting object inserted in a predetermined position in the housing, (d) a rectangular recess provided in a region of the bottom portion of said housing corresponding to tips of all said contacts extending from said holding bar upwardly and toward the interior of said housing, and (e) a contact buckling-preventing plate provided in said recess, where said plate comprises:

i. an upper surface portion formed with through-holes at locations corresponding to said contact portions of the respective contacts, ii. partition walls forming defined spaced therebetween for housing said contacts in cooperation with the upper surface portion, and iii. pivot joints to be connected to both lateral inner ends of said recess and positioned on the side of said holding bar in a manner to allow pivotal movement of said contact buckling-preventing plate.

19. A connector for receiving and electronically connecting to a card shaped connecting object comprising a housing made of an electrically insulating material having a bottom portion and side walls, and a plurality of electrical contacts made of an elastic material held in the bottom portion of said housing, and the bottom portion of said housing having a holding bar for holding the contacts in a laterally aligned relationship at predetermined intervals, and said contacts each having a contact portion at a location where it contacts a contact element provided on a card-shaped connecting object inserted in a predetermined position in the housing, wherein a rectangular recess is provided in a region of the bottom portion of the housing corresponding to tips of all said contacts extending from said holding bar upwardly and toward the interior of said housing, and a contact buckling-preventing plate is provided in said recess, which comprises an upper surface portion formed with through-holes at locations corresponding to said contact portions of the respective contacts, partition walls forming defined spaces therebetween for housing said contacts in cooperation with the upper surface portion, and pivot joints to be connected to both lateral inner ends of said recess positioned on the side of said holding bar in a manner to allow pivotal movement of the contact buckling-preventing plate, wherein said pivotal movement of the contact buckling-prevention plate is allowed by pivoting means provided on said buckling-prevention plate and the housing and the pivotal movement is caused by insertion of said card shaped connecting object and said pivotal movement is restricted by stopper means.

* * * * *